United States Patent [19]

Noma et al.

[11] Patent Number: 4,699,864

[45] Date of Patent: Oct. 13, 1987

[54] IMAGE FORMING METHOD USING LONG WAVELENGTH LIGHT SOURCE

[75] Inventors: Akira Noma, Tokyo; Izumi Osawa, Ikeda, both of Japan

[73] Assignee: Minolta Camera Kabushiki Kaisha, Osaka, Japan

[21] Appl. No.: 828,269

[22] Filed: Feb. 11, 1986

[30] Foreign Application Priority Data

Feb. 12, 1985 [JP] Japan ..... 60-026112

[51] Int. Cl.[4] ..... G03G 13/22

[52] U.S. Cl. ..... 430/100; 430/31

[58] Field of Search ..... 430/31, 55

[56] References Cited

U.S. PATENT DOCUMENTS

| | | | |
|---|---|---|---|
| 4,340,656 | 7/1982 | Seino et al. | 430/55 X |
| 4,362,797 | 12/1982 | Shimizu | 430/55 |
| 4,489,149 | 12/1984 | Kawamura et al. | 430/65 |
| 4,491,626 | 1/1985 | Kawamura et al. | 430/69 |
| 4,538,901 | 9/1985 | Soumiya | 430/31 X |
| 4,547,447 | 10/1985 | Ueda | 430/78 |
| 4,578,332 | 3/1986 | Toda et al. | 430/55 |

FOREIGN PATENT DOCUMENTS

| | | | |
|---|---|---|---|
| 47-18590 | 5/1972 | Japan | 430/31 |
| 59-149152 | 5/1984 | Japan . | |

*Primary Examiner*—Roland E. Martin

*Attorney, Agent, or Firm*—Burns, Doane, Swecker & Mathis

[57] ABSTRACT

The invention disclosed relates to an image forming method using long wavelength light source. The method comprises a first step of charging and irradiating a photosensitive member to thereby form a negative electrostatic latent image; a second step of developing said negative electrostatic latent image by a reversal development; a third step of irradiating said photosensitive member with long wavelength light; a fourth step of transferring the developed electrostatic latent image to a paper; and a fifth step of irradiating said photosensitive member with long wavelength light. Said irradiating light used at the third step has the same or close wavelength region as the one used at the first step, and further, said irradiating light used at the fifth step has the same or close wavelength region as the one used at the first and third steps.

6 Claims, 16 Drawing Figures

IMAGE FORMING METHOD USING LONG WAVELENGTH LIGHT SOURCE

BACKGROUND OF THE INVENTION

1. Field of the Invention

The present invention relates to an image forming method for visualizing by a reversal development an electrostatic latent image formed through an exposure to a long wavelength light as an image exposing light source such as a laser beam, and more particularly to an image forming method using long wavelength light source for preventing generation of a memory phenomenon on a copy obtained wherein the preceding formed image appears on the next copying cycle due to the generation of excess carriers at the time of the repeated copying operation.

2. Description of the Prior Art

In recent years, printers have been proposed according to various needs for information processing, wherein a long wavelength light source such as semiconductor laser is used as an image exposing source. With this, photosensitive members have been developed which are sensitized in the region of long wavelengths. For example, there has been proposed a photosensitive member wherein amorphous silicon or amorphous silicon: germanium is formed on a substrate by the glow discharge decomposition process, one wherein selenium alloy is vapor-deposited and further another one wherein copper-phthalocyanine or CdS is dispersed in a binder resin for coating on the substrate.

On the other hand, in the printer using the above-mentioned photosensitive member which is sensitized in the region of long wavelengths, the photosensitive member should preferably be irradiated with light of long wavelength similar to the one used for image exposing at the time of erasing the residual potential, as it is best to utilize the inherent sensitivity characteristics of the photosensitive member itself. However, the irradiation for erasing the residual potential with long wavelength light generates charge carriers in the entire photoconductive layer which remain for a limited time until the charging step for the formation of the latent image prevents excess carriers from recombining thereby causing reduction of the charged surface potential.

On the other hand, irradiation for erasing with a small quantity of light in order to prevent the reduction of the surface potential is insufficient to erase the residual potential completely thereby causing a memory phenomenon, wherein the preceding image appears on the following copying cycle. Therefore, the photosensitive member must be irradiated for erasing the residual potential with a large quantity of light as well as be charged with a large charging output in order to remove the memory phenomenon without reducing the surface potential. However, there arises such a drawback that the large charging output hastens deterioration of photosensitive members because of the influence by corona ions on photosensitive members.

The generation of the memory phenomenon will be detailed hereinbelow.

FIG. 1*a* to FIG. 1*e* show a conventional image forming method. In FIG. 1*a*, a photosensitive member 1 comprising a substrate and a photoconductive layer formed thereover is positively charged and then exposed with a laser 2 having long wavelength light source. The exposing portion (image portion) (a) exposed with long wavelength light is light-excited in the photoconductive layer to generate charge carriers, whereas no charge carriers are generated in the non-exposing portion (non-image portion) (b). With the generation of charge carriers in the exposing portion, electrons neutralize positive charges on the surface of the photoconductive layer, whereas holes move toward the substrate. Thus formed electrostatic latent image is visualized with a reversal development as shown in FIG. 1*b* wherein toner is deposited on the exposing portion (a) of the photoconductive layer.

The developed image is then transferred onto a paper, while the photosensitive member, after having removed the residual toner, is irradiated with long wavelength light 3 in order to erase the residual potential. By this, the photoconductive layer is wholly light-excited, so that electrons neutralize positive charges on the surface, whereas holes move toward the substrate at the non-exposing portion (b). However, at the exposing portion (a), the surface potential has already decreased at the time of image exposing, with the result that the excess carriers incapable of recombining remain in the photoconductive layer. When the photosensitive member is, in this state, charged by a corona charger 4 for carrying out the next copying cycle, the excess carriers remaining in the exposing portion (a) recombine with the charges charged by the charger (4) as shown in FIG. 1*d*, i.e., electrons recombine with positive charges on the surface of the photosensitive member. On the other hand, no excess carriers are present in the non-exposing portion (b). Consequently, there arises the difference of the surface potential between in the exposing portion (a) and in the non-exposing portion (b) as shown in FIG. 1*e*, to thereby cause the memory phenomenon.

Moreover, when the photosensitive member is to be charged to a predetermined surface potential in the above-described method, the irradiating light must be set to the value in quantity of preventing the generation of the residual potential. However, this in turn brings about the drawbacks of the requirement to irradiate with a large quantity of light as well as to charge the photosensitive member to a predetermined surface potential with large quantity of electric current. Such drawbacks as mentioned above are unavoidable regardless of the charging polarity.

As described above, printers using in particular the long wavelength light as an image exposing source cause the memory phenomenon to occur during repeated copying cycles, with the result that satisfactory copies cannot be obtained. This fact is remarkably observed in using a photosensitive member sensitized in the region of long wavelength. That is because such kind of photosensitive member is constituted to narrow the optical band gap in order to generate pairs of carriers in the photoconductive layer by low energy light, and as a result, carriers are generated in excess to cause the memory phenomenon. Moreover, in the photosensitive member described above, the irradiating light for preventing the generation of the residual potential and the electric current for charging the photosensitive member to a predetermined surface potential are required to be set to high quantities thereby placing various restrictions on the setting condition for forming images to greatly influence the photosensitive member.

SUMMARY OF THE INVENTION

It is accordingly a primary object of the present invention to provide an image forming method using a long wavelength light source which is free of said drawbacks and is capable of obtaining satisfactory copying images.

Another object of the present invention is to provide an image forming method wherein a photosensitive member sensitized in the region of long wavelength is exposed with long wavelength light to form an electrostatic latent image for consequent visualization by a reversal development without causing so called memory phenomenon in repetitive copying operation.

Still another object of the present invention is to provide an image forming method using a long wavelength light source which is capable of charging the photosensitive member with a relatively small charging output to a predetermined surface potential.

These and other objects of the present invention are accomplished by providing an image forming method using a long wavelength light source which comprises a first step of charging uniformly a photosensitive member, a second step of irradiating said photosensitive member with the long wavelength light source to a negative image to thereby form a negative electrostatic latent image; a third step of developing said negative electrostatic latent image by a reversal development; a fourth step of irradiating said photosensitive member with a long wavelength light having the same or close to the same wavelength region as the irradiating light used in the second step; a fifth step of transferring the image to a paper; and a sixth step of irradiating said photosensitive member with long wavelength light having the same or close wavelength region as the irradiating light used in the second and fourth steps.

DETAILED DESCRIPTION OF THE INVENTION

Figure 1A:
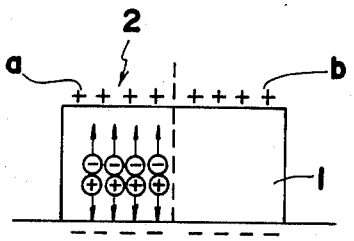
Prior Art FIG.1a
FIGS. 1*a* to 1*e* are diagrams illustrating steps of a conventional image forming method.
Figure 1B:
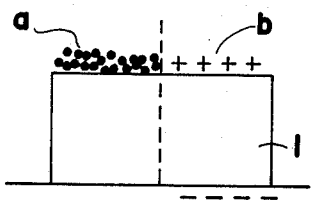
Figure 1C:
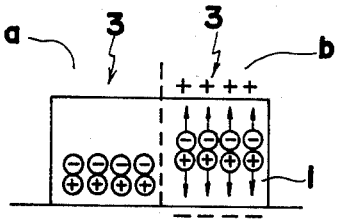
Figure 1D:
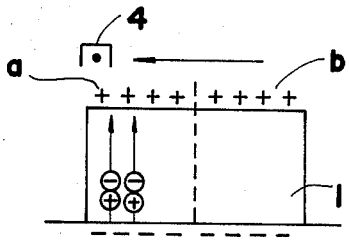
Figure 1E:
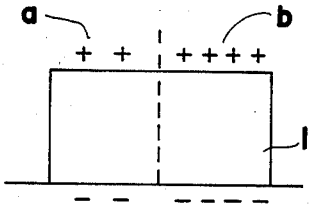
Figure 2:
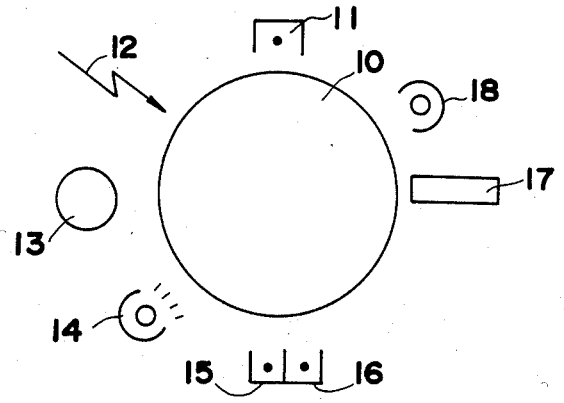
FIG. 2 is a diagram schematically showing the construction of a printer for practicing an image forming method according to the present invention.

FIG. 2 generally shows the construction of a laser beam printer which is adapted to practice the image forming method of the present invention. Indicated at 10 is a photosensitive member comprising at least a photoconductive layer formed on a conductive drum such as aluminum. Said photosensitive member preferably has high sensitivity in the region of long wavelength light (650 nm to 850 nm). Such photosensitive member may be the one shown in U.S. Pat. No. 4,489,149 which comprises a photoconductive layer of amorphous silicon produced by a glow discharge decomposition process, U.S. Pat. No. 4,491,626 which discloses a photoconductive layer of amorphous silicon: germanium produced by the glow discharge decomposition process or the one shown in U.S. Pat. No. 4,547,447 which is formed by vapor-depositing copper phthalocyanine or by coating a dispersion of copper phthalocyanine in a binder resin. Other examples are the photosensitive members formed by vapor-depositing selenium alloy and the one comprising bisazo pigment or CdS or the like dispersed in a binder resin.

Around the photosensitive member 10 are provided a corona charger 11 for charging uniformly the photosensitive member to a predetermined polarity, an image exposing source 12 for irradiating an image with long wavelength source such as a semiconductor laser, a developing means 13 for developing a negative electrostatic latent image, a first eraser 14 for irradiating the photosensitive member with light of wavelength having the same or close wavelength as said image exposing source 12, a transfer charger 15 for transferring the developed image onto a paper, a separating charger 16 for separating the paper from the photosensitive drum 10, a blade cleaner 17 for removing the residual toner from the drum surface and a second eraser 18 for irradiating the photosensitive member with light having the same or close wavelength region as said image exposing source 12 and first eraser 14.

The image forming method according to the present invention practiced by the laser beam printer of the above construction will be explained in detail based on FIGS. 3*a* to 3*e*.

The first step is to charge the photosensitive member 10 to a predetermined polarity, e.g., to a positive polarity by the corona charger 11. By this, the photosensitive member is charged to a predetermined surface potential.

Figure 3A:
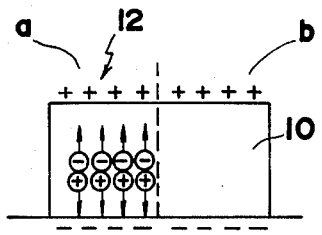
FIGS. 3*a* to 3*e* are diagrams showing steps of the image forming method of the present invention.

The second step is, as shown in FIG. 3*a*, to expose the uniformly charged photosensitive member 10 to a negative image by the image exposing source 12 having long wavelength light emitting source (650 to 850 nm). By this, the irradiated portion (a) corresponding to the image portion is exposed with light to generate charge carriers. Of the carriers, electrons move to neutralize the surface charges, while holes move toward the substrate. On the other hand, no charge carriers are generated in the non-irradiated portion (b) corresponding to the non-image portion since this portion (b) is not irradiated with light. Therefore, the surface potential remains to form a negative electrostatic latent image.

Figure 3B:
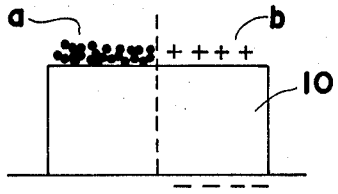

The third step is, as shown in FIG. 3*b*, to reversely develop said electrostatic latent image with the developing means 13. One example is to develop by a magnetic brush developing means wherein toners are deposited on the irradiated portion (a) with an application of a bias voltage which is lower than the potential of the non-irradiated portion (b) to a developing electrode.

Figure 3C:
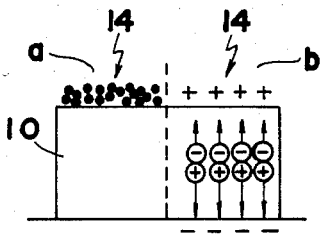

In the following fourth step, the developed electrostatic latent image on the photosensitive member 10 is irradiated by the first eraser 14 as shown in FIG. 3*c*. This first eraser 14 is for irradiating long wavelength light having the same or close to the same wavelength region as said image exposing source 12. As detailed in examples hereinafter, a photosensitive member comprising a photoconductive layer of amorphous silicon is preferably irradiated with light having a wavelength of above 650 nm and a quantity of about 7 to 30 ergs/cm$^2$.

The reason of irradiating the photosensitive member with such a small quantity of light is that the member sensitized in the long wavelength region has a narrow optical band gap as described above so as to absorb long wavelength light all over the photoconductive layer. Accordingly, when the photosensitive member 10 is irradiated by the first eraser 14 in the fourth step, the irradiated portion (a) does not absorb light because of toners deposited on this portions, while the non-irradiated portion (b) absorbs light to generate charge carriers, electrons which neutralize positive charges on the surface of the drum 10. More specifically, the irradiated portion (a) is irradiated in the second step and the non-irradiated portion (b) is irradiated by the first eraser 14 in the fourth step so that both the irradiated portion (a) and the non-irradiated portion (b) are exposed. Further, the first eraser 14 irradiates the photosensitive member with long wavelength light having the same or close to the same wavelength region as the image exposing source 12 used in the second step, so that the photosensitive member in effect has been irradiated with only a single exposing source. As a result, the irradiated portion (a) has substantially the same irradiation hysteresis as the non-irradiated portion (b) so that the residual potential of the portion (a) is substantially equal to that of the portion (b).

Subsequently, the fifth step is to transfer the toner image onto a copy paper by the transfer charger 15 to form a positive image thereon and then to separate the image-bearing paper from the photosensitive member by the separating charger 16. Meanwhile, residual toners on the photosensitive member are removed by the blade cleaner 17.

Figure 3D:
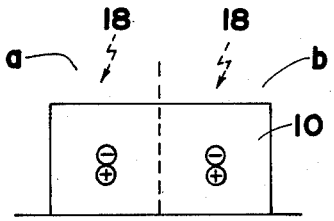

The sixth step is, as shown in FIG. 3*d*, to irradiate entire surface of the photosensitive member by the second eraser 18 to generate charge carriers so as to erase almost all the residual charges on the photosensitive member. The irradiating light at this time should preferably be the one with long wavelength having the same or close to the same irradiating wavelength as in the second and fourth steps. In addition, said irradiating light is only required to have about one fifth to one fortieth the quantity of the irradiating light of the first eraser 14. More specifically, the photosensitive member is, in the sixth step, irradiated with long wavelength light having the same or close to the same wavelength region as the image exposing source 12 and the first eraser 14 to absorb light all over the photoconductive layer, with the result that the residual charges in the photoconductive layer are erased. The reason why such a small irradiating light having about one fifth to one fortieth the quantity of the first eraser 14 (for the photosensitive member comprising a photoconductive layer of amorphous silicon, the quantity of irradiating light is about 0.18 to 6 ergs/cm$^2$) is capable of erasing the residual charges is that the residual potential has already decreased greatly in the fourth step. If the irradiating light in the sixth step is too large in quantity, the surface potential decreases during the next copying cycle. Moreover, the quantity of light of the second eraser 18 used in the sixth step should preferably be set to a value as small as possible to prevent the generation of the residual potential at the time of charging the photosensitive member to a predetermined surface potential. Together with the setting of the quantity of the exposing light of the second eraser 18, the first eraser 14 is set to the value which is free of causing the memory phenomenon. Such setting greatly decreases the quantity of electric current for charging the photosensitive member to a predetermined surface potential by the corona charger 11.

Figure 3E:
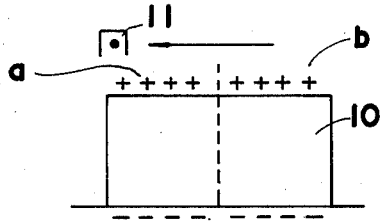

The photosensitive member subjected through the above-described first to sixth steps has no excess carriers, and further, when charged by the corona charger 11 in the first step as shown in FIG. 3*e* for carrying out the repeated copying cycle, there is no difference of potential between the exposing portion (a) and the non-exposing portion (b). In other words, the photosensitive member is uniformly charged. Accordingly, the conventional memory phenomenon does not occur, and satisfactory copy images can be obtained.

In the above description, a tungsten lamp is preferably used for the first and the second erasers 14 and 18. In this case, a preferable color temperature is in the neighborhood of 2500° K where a component of long wavelength is largely contained. Furthermore, the same effect can be obtained by using a red fluorescent lamp or a red emitting diode for the first and the second erasers 14 and 18. Additionally, the photosensitive member irradiated with the image exposing source 12 must have the same or close to the same light decay characteristics as the one irradiated with the first eraser 14.

Examples will be detailed hereinbelow.

EXAMPLE 1

By using the known glow discharge decomposition apparatus of the capacitive coupling type, three kinds of photosensitive members A, B and C were produced.

The photosensitive member A comprises on an aluminum drum a photoconductive layer composed substantially of amorphous silicon with a part thereof having a layer of amorphous silicon: germanium containing about 25 at.% of germanium. Said photosensitive member A has a total thickness of about 30 μm. The photosensitive member B has the same construction as the member A except that germanium included in the photoconductive layer is in an amount of about 10 at.%. The photosensitive member C comprises on an aluminum drum a photoconductive layer of 30 μm thick composed substantially of amorphous silicon and including no germanium.

Figure 4:
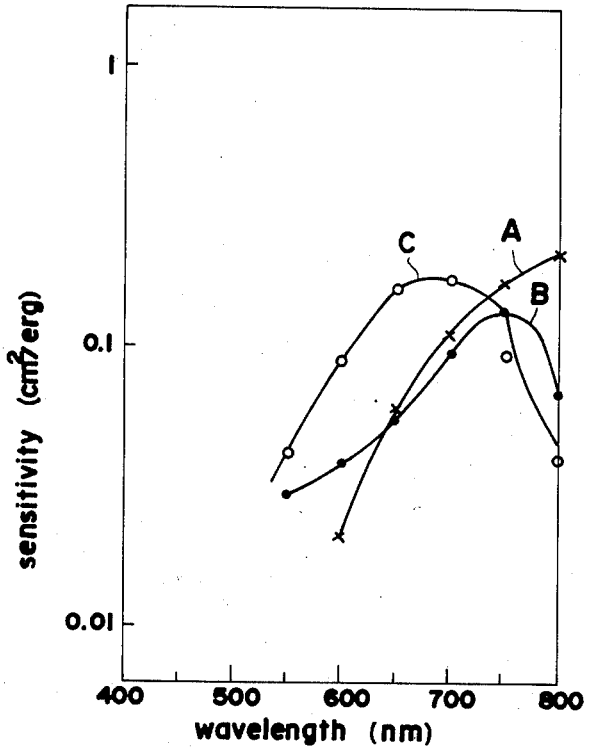
FIG. 4 shows spectral sensitivities of photosensitive members suitable for use in the image forming method of the present invention.

The spectral sensitivity characteristics of each photosensitive member A, B and C are shown as the curves A, B and C respectively in FIG. 4. As is apparent from FIG. 4, every photosensitive member has a high sensitivity in the long wavelength region of about 650 nm to 800 nm. Particularly, the photosensitive members A and B including germanium have a higher sensitivity than the photosensitive member C including no germanium. Like the photosensitive members A, B and C, the present invention uses photosensitive members having a high sensitivity in the long wavelength region of above 650 nm.

EXAMPLE 2

Using the printer as shown in FIG. 2, an image forming experiment was carried out along with the observation of the occurrence of the memory phenomenon, quantity of the charging electric current and the like. The photosensitive member A of 80 mm in diameter shown in the Example 1 was employed as the photosensitive drum 10 and the semi-conductor laser having the emitting wavelength of 780 nm was used as the image exposing source 12. Moreover, the first and the second erasers 14, 18 of tungsten lamps having respectively a color temperature of 2500° K had the emitting wavelength region of (F) shown in FIG. 5.

The image forming experiment was carried out according to the method as shown in FIGS. 3*a* to 3*e* with the photosensitive drum 10 rotating at the speed of 35 RPM. At first, the photosensitive member was charged to a surface potential of 600 V by the corona charger 11, and then exposed to a negative image by the semi-conductor laser 12 having the emitting wavelength of 780 nm to form a negative electrostatic latent image. Subsequently, with the developing means 13, said electrostatic latent image was developed by a magnetic brush developing method with application of the 450 V bias voltage to a developing electrode. By this, toners were deposited on the exposing portion (a). Next, the photosensitive member was irradiated with the first eraser 14 and the toner image was transferred onto a paper by the transfer charger 15. Said member was then irradiated with the second eraser 18 after having removed the residual toner by the blade cleaner 17, and charged again by the corona charger 11 to repeat the image forming.

Figure 6:
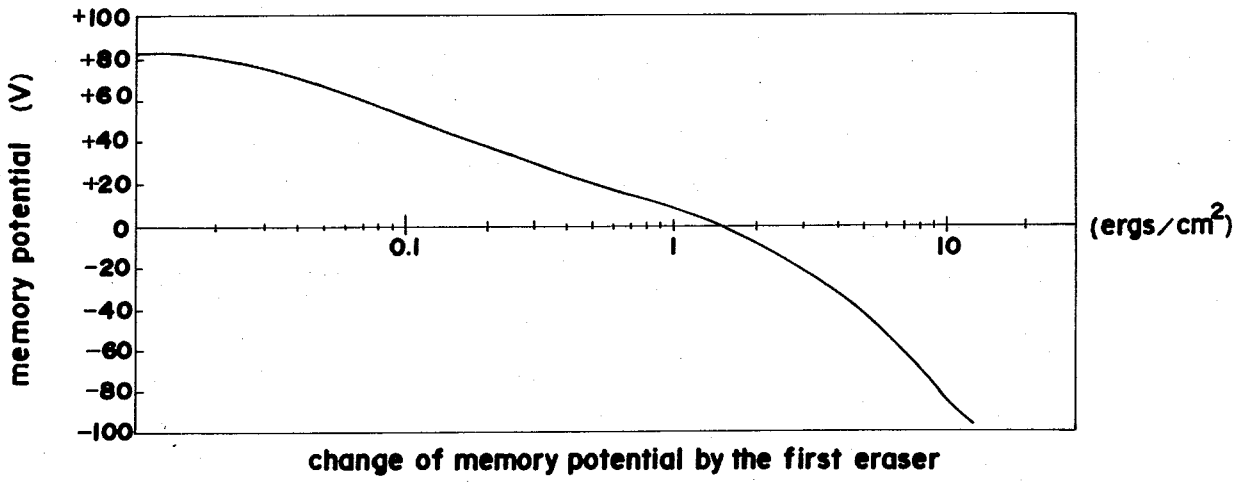
FIG. 6 and FIG. 8 are diagrams showing the relation between the light quantity of the first eraser and a memory potential.

When the photosensitive drum 10 was charged to the surface potential of 600 V while irradiating by the first eraser 14 in the process of said image forming experiment, memory potential was measured while the second eraser 18 was selected to have a minimum quantity of exposing light free from the generation of residual potential. This memory potential means the difference of the surface potential between the exposing portion (a) and the non-exposing portion (b) of the drum which are charged from the second rotation by the corona charger 11. That is, such potential difference being the difference of potential between (a) and (b) of FIG. 3*e*. The results of the measurements are shown in FIG. 6 wherein the ordinate represents memory potential and the abcissa represents the quantity of light of the first eraser. Memory potential, when being positive or negative memory, causes an image deterioration. In this case, positive memory means the surface potential which is larger at the exposing portion (a) than at the non-exposing portion (b), and negative memory means the surface potential which is smaller at the exposing portion (a) than at the non-exposing portion (b) in FIG. 3*e*. If memory potential is in the range from −10 V to +10 V, satisfactory copy images can be obtained without the image deterioration caused by appearance of the preceding image during the next copying cycle. As is apparent from FIG. 6, memory potential can be set within the range from −10 V to +10 V with the first eraser 14 having the quantity of light in an amount of about 0.8 to 2 lux·Sec (about 7 to 20 erg/cm$^2$). Furthermore, the second eraser 18 has the quantity of light in an amount of only 0.4 lux·sec in the range of this quantity of light of the first eraser 14. Additionally, under these conditions, the photosensitive drum 10 can be charged to the surface potential of 600 V by the corona charger with electric current in an amount of 127 μA which is greatly smaller than that used in the conventional example described later.

Moreover, the repeated copying with first eraser 14 set to have the quantity of light in said amount of 0.8 to 2 lux·sec and the second eraser 18 set to have the quantity of light in an amount of 0.4 lux·sec have been found to provide sharp images without the occurrence of the memory phenomenon.

EXAMPLE 3

Figure 5:
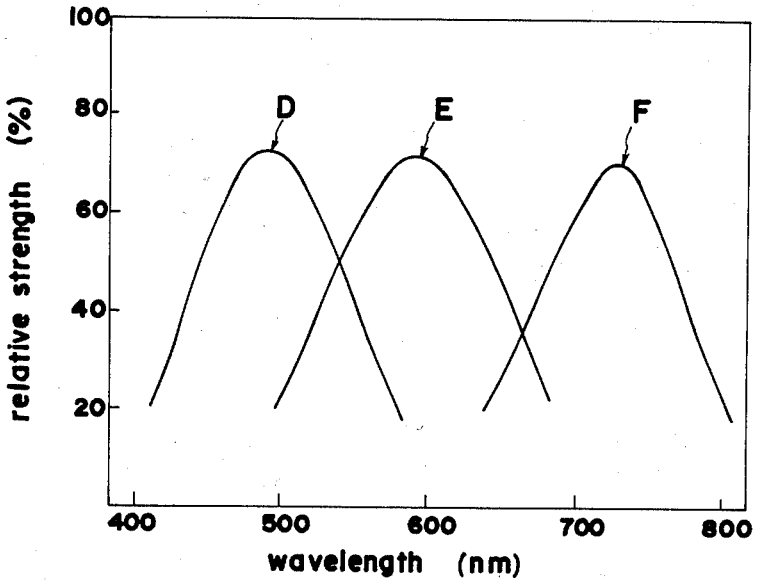
FIG. 5 is a diagram showing various regions of the emitting wavelengths of a first and a second erasers.
Figure 7:
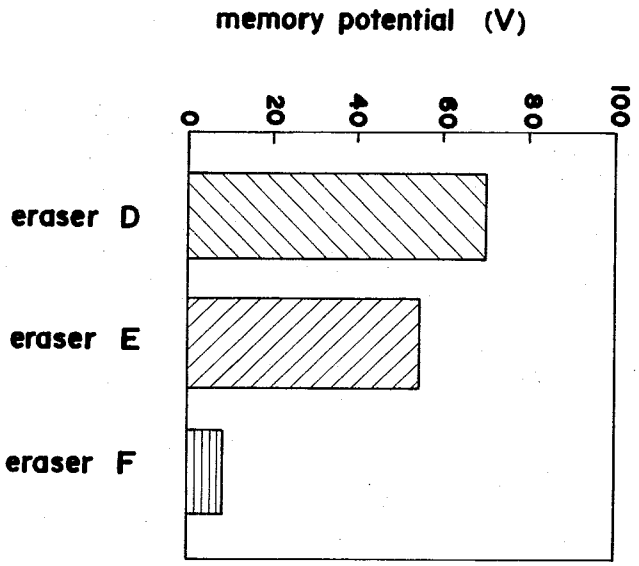
FIG. 7 is a diagram showing the relation between the characteristics of the emitting wavelength of the erasers and the memory potential.

Memory potential was measured under the same condition as the Example 2 except that the first eraser 14 having the quantity of light in an amount of 0.9 lux·sec and having the respective wavelength characteristics of D, E and F shown in FIG. 5 was used. FIG. 7 shows the result of the measurements. As is apparent from FIG. 7, the memory potentials show high values of 70 V and 55 V respectively with the use of the light source having the wavelength characteristics of D and E which are unlike the emitting wavelength of 780 nm of the image exposing source 12. On the other hand, the memory potential is less than 10 V with the use of the light source having the similar wavelength characteristics of F to the emitting wavelength of the image exposing source 12, and as a result, sharp copying images were obtained.

EXAMPLE 4

Figure 8:
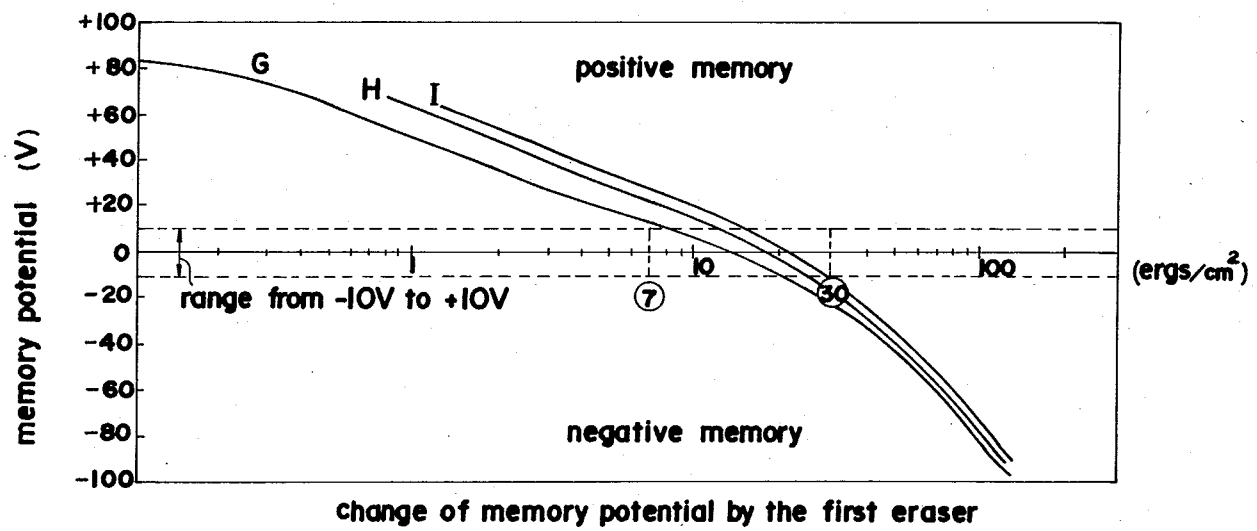

Memory potentials were measured under the same condition as the Example 2 using the photosensitive members B and C produced in the Example 1. The results are shown in FIG. 8 therewith the erase potential of the photosensitive member A shown in FIG. 6. The curves G, H and I correspond to the change in memory potential of the photosensitive members A, B and C respectively. The results of the measurements show that the photosensitive members B and C, when having the first eraser 14 with the light quantities of about 12 to 26 ergs/cm$^2$ and about 15 to 30 ergs/cm$^2$ respectively, have the memory potential ranging from −10 V to +10 V which prevent the image deterioration. As is apparent from these results, a photosensitive member composed of amorphous silicon as its main constituent should preferably be exposed to the first eraser with the quantity of light in an amount of about 7 to 30 ergs/cm$^2$.

COMPARATIVE EXAMPLE 1

An image forming experiment was carried out under the same condition as the Example 1, except that the first eraser 14 was not lighted and the second eraser 18 was set to have minimum quantity of light of 0.8 lux·sec which is free of the generation of the residual potential upon charging the photosensitive drum to the surface potential of 600 V. In this case, the photosensitive drum requires the electric current in an amount of 183 μA for charging said drum to the surface potential of 600 V by the corona charger 11 at the time of the second rotation. Further, the memory potential showed the high value of +88 V causing great image deterioration.

COMPARATIVE EXAMPLE 2

The copying operation was repeatedly carried out under the same condition as the Example 2, except that the first eraser ws set to have the light quantity of 0.4 to 2 lux·sec, whereas the second eraser was not lighted. The result shows the image fog to have appeared after several copies have been made.

As is apparent from the above description, an image forming method according to the present invention prevents the occurrence of the memory phenomenon which is attributable to the fact that the preceding image appears during the next copying because of the generation of excess carriers at the time of the repeated copying. Additionally, said image forming method requires only a small amount of an electric current for charging a photosensitive member as well as simple setting of conditions for forming an image, so that satisfactory copy images can be obtained.

What is claimed is:

1. An image forming method using a long wavelength light source comprising:

a first step of charging and irradiating a photosensitive member to thereby form a negative electrostatic latent image;

a second step of developing said negative electrostatic latent image by a reversal development;

a third step of irradiating said photosensitive member with a wavelength light having the same or close to the same wavelength region as the irradiating light used in said first step;

a fourth step of transferring the developed electrostatic latent image to a paper; and a fifth step of irradiating said photosensitive member with a wavelength light having the same or close to the same wavelength region as the irradiating light used in said first and third steps, the quantity of said light being one-fifth to onefortieth the quantity of irradiating light used in said third step.

2. An image forming method comprising:

a first step of charging uniformly a photosensitive member to a predetermined surface potential of a specific polarity;

a second step of irradiating said photosensitive member with a long wavelength light source to a negative image to thereby form a negative electrostatic latent image;

a third step of developing said negative electrostatic latent image by a reversal development;

a fourth step of irradiating entirely said photosensitive member with a long wavelength light having the same or close to the same wavelength region as the irradiating light used in said second step;

a fifth step of transferring the developed electrostatic latent image to a paper; and a sixth step of irradiating entirely said photosensitive member with a long wavelength light having the same or close to the same wavelength region as the irradiating light used in said second and fourth steps, the quantity of said long wavelength light being one-fifth to one-fortieth the quantity of irradiating light used in said fourth step.

3. An image forming method as claimed in claim 2 wherein said irradiating light employed in the second, fourth and sixth steps is 650 to 850 nm in emitting wavelength.

4. An image forming method as claimed in claim 2 wherein said photosensitive member comprises a photoconductive layer including amorphous silicon.

5. An image forming method as claimed in claim 4 wherein said photosensitive member is irradiated with light of about 7 to 30 ergs/cm$^2$ in quantity at the fourth step.

6. An image forming method as claimed in claim 4 wherein said photosensitive member is irradiated with light of about 0.18 to 6 ergs/cm$^2$ in quantity at the sixth step.

* * * * *